US005220390A

United States Patent [19]

Ohtani et al.

[11] Patent Number: 5,220,390

[45] Date of Patent: Jun. 15, 1993

[54] ELECTROPHOTOGRAPHIC IMAGE FORMING PROCESS

[75] Inventors: Junji Ohtani; Eiichi Sano; Masahiro Anno, all of Osaka, Japan

[73] Assignee: Minolta Camera Kabushiki Kaisha, Osaka, Japan

[21] Appl. No.: 885,236

[22] Filed: May 19, 1992

Related U.S. Application Data

[63] Continuation of Ser. No. 590,584, Sep. 24, 1990, abandoned, which is a continuation of Ser. No. 269,601, Nov. 10, 1988, abandoned.

[30] Foreign Application Priority Data

Nov. 11, 1987 [JP] Japan ..... 62-284594

[51] Int. Cl.[5] ..... G03G 21/00

[52] U.S. Cl. ..... 355/296; 430/125

[58] Field of Search ..... 355/296, 297, 299, 306; 430/125, 111, 137

[56] References Cited

U.S. PATENT DOCUMENTS 4,785,324 11/1988 Yamazaki et al. ..... 355/297

4,963,454 10/1990 Yano et al. ..... 430/137 X

FOREIGN PATENT DOCUMENTS 1107078 5/1989 Fed. Rep. of Germany ..... 430/125

59-102252 6/1984 Japan .

OTHER PUBLICATIONS

M. D. Avritt and P. G. Robinson, "Cleaning Procedure for Overcoated Photoconductor Drum Or The Like", IBM Technical Disclosure Bulletin, vol. 24, No. 12, May 1982.

M. D. Avritt & P. G. Robinson, Cleaning Process for Drum IBM Tech. Disc. Bulletin, p. 6883, vol. 24, No. 12, May 1982.

*Primary Examiner*—A. T. Grimley

*Assistant Examiner*—Sandra L. Brasé

*Attorney, Agent, or Firm*—Burns, Doane, Swecker & Mathis

[57] ABSTRACT

The invention disclosed relates to an image forming process. The image forming process which comprises a first step of forming an electrostatic latent image on the surface of a photosensitive member, a second step of developing said latent image with spherical toner particles, a third step of transferring the developed image to a transfer material, a fourth step of depositing irregularly shaped toner particles to the surface of the photosensitive member, and a fifth step of cleaning the surface of the photosensitive member by a cleaning blade.

10 Claims, 1 Drawing Sheet

ELECTROPHOTOGRAPHIC IMAGE FORMING PROCESS

This application is a continuation of application Ser. No. 07/590,584, filed Sep. 24, 1990 now abandoned which is a continuation application of Ser. No. 07/369,601, filed Nov. 10, 1988 now abandoned.

BACKGROUND OF THE INVENTION

1. Field of the Invention

The present invention relates to an image forming process for use in electrophotographic copy machines and printers which employ monocomponent and bicomponent developers.

2. Description of the Prior Art

To obtain an image from an electrophotographic copy machine or printer, an electrostatic latent image must first be formed on the surface of a photosensitive member, i.e. an image bearing member. Next, the surface of the photosensitive member having the electrostatic latent image formed thereon is developed with a developer and the obtained toner image is transferred to paper or other media.

The developer used in electrophotographic copy machines and the like is mainly bicomponent developer comprising an insulated non-magnetic toner and magnetic carrier, a monocomponent developer comprising a non-magnetic toner. or a monocomponent developer comprising an insulated magnetic toner.

These types of toner are usually made from thermoplastic resin, coloring agent, and charge regulating agent. In the case of magnetic toner, magnetic particles are incorporated with the aforesaid components.

In recent years in this type of electrophotography, extra small toner was studied as a means of achieving high accuracy images. However, the aforesaid extra small toner has poor flow characteristics, and the photosensitive member is inadequately cleaned following the developing process. Cleaning consists of removing the toner that has not been transferred to the copy paper and which remains adhering to the surface of the photosensitive member by means of a rubber blade. When said cleaning is inadequate, sharp images cannot be formed in subsequent cycles.

Making the toner shape spherical was also studied as a means for stabilizing the amount of charge and improving the flow characteristics, but the spherical particles were also caused the disadvantage of greatly worsening cleaning conditions.

Japanese Laid-Open Patent Application No. 59-102252 discloses the use of a toner which incorporates both spherical toner particles and more uniformly small diameter, irregularly shaped toner particles to improve the unsatisfactory cleaning characteristics caused by making the previously mentioned spherical toner and smaller toner.

Although excellent flow characteristics, very sharp latent image formability and the like are properties of spherical toner, these characteristics were not obtained when a toner mixture incorporating both spherical and irregularly shaped toner was used for developing.

SUMMARY OF THE INVENTION

The main object of the present invention is to provide an image forming process capable of obtaining a sharp and clear image with spherical toner particles.

Another object of the invention is to provide an image forming process capable of certainly cleaning the surface of a photosensitive member in spite of using the spherical toner particles for development.

These and other objects of the present invention can be accomplished by providing an image forming process comprising a first step of forming an electrostatic latent image on the surface of a photosensitive member, a second step of developing said latent image with spherical toner particles, a third step of transferring the developed image to a transfer material, a fourth step of depositing irregularly shaped toner particles to the surface of the photosensitive member, and a fifth step of cleaning the surface of the photosensitive member by a cleaning blade.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
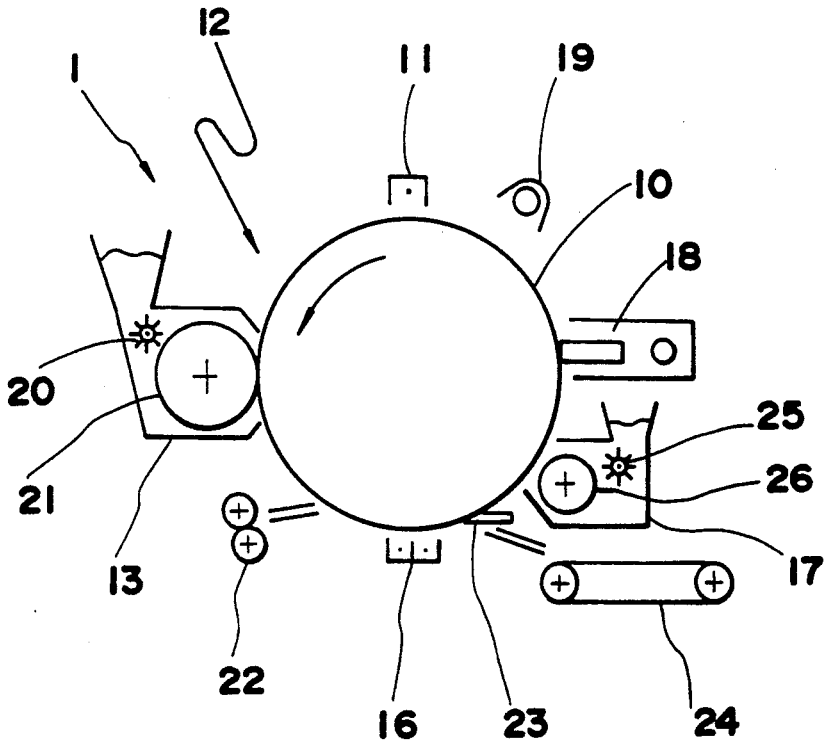
FIG. 1 is a schematic cross-sectional view of a device embodying the image forming process of the present invention.

The present invention is concretely described hereinafter with reference to FIG. 1. FIG. 1 is a schematic cross-sectional view of the developing device embodying the image forming process of the present invention. In FIG. 1, developing device 1 provides a main charger 11, exposure unit 12, developing device 13 which uses spherical toner, transfer charger 16, supply device 17 which uses irregularly shaped toner, cleaning blade 18, and eraser lamp 19 arranged around a photosensitive drum 10. While photosensitive drum 10 rotates in the arrow direction, various processing is performed in the sequence of charging, exposure, developing by spherical toner, transfer, depositing irregularly shaped toner, and cleaning.

Thus, the image forming process is accomplished in accordance with the following processes "a" through "g."

(a) The surface of photosensitive drum 10 is uniformly charged by main charger 11.

(b) The photosensitive drum 10 is exposed to light from exposure device 12 and an electrostatic latent image is formed.

(c) The electrostatic latent image is developed by developing unit 13. A bicomponent magnetic developer incorporating spherical toner and a carrier is used. The spherical toner is transported from a hopper to inside the developing unit and suitably mixed with the carrier by means of mixing blades 20 so as to obtain the desired amount of charge. The aforesaid spherical toner is transported to the developing sleeve 21 by a magnetic brush and is transferred therefrom to the electrostatic latent image on photosensitive drum 10, thereby developing said image. A developing bias voltage may be applied to developing sleeve 21 to prevent fogging of the non-image portion.

(d) The obtained toner image is transferred to a recording medium such as paper by means of transfer charger 16. The paper is separated from the photosensitive drum 10 by separation claw 23 after the paper has been supplied from supply roller 22 and the transfer process is completed, said paper then being transported to the fixing process by feed belt 24.

(e) Irregularly shaped toner is supplied from the supply unit 17 and adheres to the surface of the photosensitive drum. The irregularly shaped toner is transported from the hopper to within the developing device and there suitably mixed by means of mixing blades 25 so as to obtain the desired amount of charge. The irregularly shaped toner is then transported onto developing sleeve 26 by a magnetic brush and adhered to the surface of the photosensitive drum by means of a bias voltage applied to said developing sleeve 26. The aforesaid bias voltage can be suitably selected in accordance with the characteristics of the photosensitive member, irregularly shaped toner charging characteristics and other processing conditions.

(f) Residual toner on the surface of photosensitive drum 10 is scraped off by cleaning blade 18.

(g) The surface potential of photosensitive drum 10 is reduced to near 0 V by eraser lamp 19, to prepare for subsequent charging and image formation.

The aforesaid spherical toner used in the process of the present invention comprises a binder resin, coloring agent, charge regulating agent, magnetic material, and other well known toner components. Further, the irregularly shaped toner used as the irregularly shaped particles may have the same composition as the aforesaid spherical toner. The irregularly shaped particles may be obtained by pulverizing the aforesaid binder resin alone by a suitable method without incorporating a coloring agent.

The spherical toner may be manufactured by a method for sphericalization which processes the irregularly shaped toner particles by dispersing them with heated air, spray dry method wherein toner components are dispersed and mixed in a fluid resin which is then spray dried, or a suspension polymerization process wherein a fluid dispersion comprised of a monomer of dispersed toner components is subjected to suspension polymerization.

A spherical toner diameter of 3 to 20 μm is preferred. When said toner is less than 3 μm, image density decreases, and when toner is greater than 20 μm,the image quality deteriorates.

On the other hand, the irregularly shaped toner used in the process of the present invention may be conventional irregularly shaped toner obtained, for example, by using a kneading machine to fuse and knead the aforesaid materials after adequately mixing said materials in a mixer or like device. After the obtained kneaded substance is cooled, it is finely pulverized and classified so as to obtain toner having a specific diameter of 5 to 20 μm.

An irregularly shaped toner with a mean diameter less than that of the spherical toner is preferred. Although an irregularly shaped toner having a mean diameter equal to or greater than that of the spherical toner may be used, a smaller diameter irregularly shaped toner can prevent the spherical toner from being scraped off when said irregularly shaped toner is inserted medially between the blade and photosensitive member.

When using an irregularly shaped toner charged with the opposite polarity to that of the spherical toner, the residual spherical toner and irregularly shaped toner are electrostatically attracted and adhere to one another forming larger particles which are easily removed in the cleaning process.

Examples of binder resins which may be useful in the aforesaid spherical and irregularly shaped toners include polyolefins, polyamide resins and maleic acid resins such as polystyrene, styrene-acrylic copolymer resin, polyester, epoxy resin, polyethylene, polypropylene and like, or commonly known modified resins thereof. The aforesaid resins may be used singly or in compounds incorporating two or more.

Examples of useful coloring agents are organic pigments and dyes such as carbon black, phthalocyanines, xanthenes and the like.

Other commonly known additives may be incorporated as required, including charge regulating agents such as nigrosine dyes and triphenylmethane dyes, fluidizing agents such as silica, titanium oxide and vinylidene fluoride, or separation agents such as polypropylene and polyethylene.

In the case of a monocomponent magnetic developer comprised of toner alone, the magnetic material incorporated in the magnetic toner may be, for example, metals such as iron, nickel, cobalt and the like, alloys or mixtures of the aforesaid metals and zinc, antimony, aluminum, copper, tin, bismuth, beryllium, manganese, selenium, tungsten, zirconium, vanadium and the like, or metallic oxides such as titanium oxide, magnesium oxide, and ferromagnetic ferrite and magnetite or mixtures thereof.

The particle diameter of the aforesaid magnetic material is 2 μm or less, preferably 1 μm or less. Further, the proportional composition of the aforesaid polymers and magnetic powder is 20 to 300 parts by weight magnetic powder to 100 parts by weight resin, although 30 to 200 parts by weight magnetic powder is preferable.

EXAMPLES

A detailed description of the present invention follows hereinafter based on production, actual and comparative examples.

Spherical Toner Production
Production Example 1

| Composition | Parts By Weight |
|---|---|
| Styrene | 60 |
| n-butyl methacrylate | 35 |
| Methacrylic acid | 5 |
| 2,2-azobis(2,4-dimethylvaleronitrile) | 0.5 |
| Low molecular weight polypropylene [Bisukohru TS-200] (Sanyo Chemical Industries, Ltd.) | 3 |
| Carbon black MA#8 (Sanyo Chemical Industries, Ltd.) | 8 |
| Nigrosine base EX (Oriental Chemical Industries, Ltd.) | 3 |

The aforesaid components were adequately mixed in a sand stirrer and adjusted to produce a polymerizable composition. The aforesaid composition was added to an aqueous solution of gum arabic (concentration: 3% by weight), and mixed in a mixer (T. K. Homogenizer, Tokushu Kogyo K. K. ) at 3,000 rpm and 60° D. for 6 hr to produce a polymerization reaction, and then was subjected to a final polymerization reaction by raising the temperature to 80° C. After completion of the reaction, the reaction system was cooled, washed five or six times, filtered, and dried to obtain the spherical particles. The mean diameter of the thus obtained spherical particles was 10.2 μm, softening point (Tm) was 141° C., and glass transition point (Ts) was 61° C.

PRODUCTION EXAMPLE 2

The monodisperse spherical styrene polymer (mean particle diameter of 7 μm, diameter coefficient of variation within 10%, softening point Tm at 128° C., glass transition point Ts at 54° C.) obtained by a seed polymerization process was designated polymer particle "A."

The aforesaid polymer "A" and carbon black (MA#8, Mitsubishi Chemical Industries, Ltd.) were mixed at a ratio of 100 to 5 parts by weight respectively, at 1,500 rpm for 5 min using a Henschel mixer 101 to obtain polymer particle "B" having a surface coating of carbon black.

Next, the aforesaid polymer "B" and sodium polyacrylate were dissolved at a ratio of 100 to 5 parts by weight respectively, in 2,000 parts by weight of water and mixed therein to obtain a dispersal system of intermediate particles dispersed in said aqueous solution. Then, 100 parts by weight of monomer comprising styrene, n-butylmethacrylate and 2,2,2-trifluoroethylacrylate in a composition ratio of 75/15/10, and 2 parts by weight of potassium persulfate as a polymerization initiator were added to said dispersal system. The temperature of the dispersal system was raised to 80° C. and polymerized for 6 hr so as to obtain toner particles comprising polymer "B" coated with a resin layer. The thus obtained toner particles had a mean diameter of 10 μm and a diameter coefficient of variation of 11%.

Irregularly Shaped Toner Production
Production Example 3 (positive charge toner)

| Composition | Parts By Weight |
|---|---|
| Styrene n-butylmethacrylate resin (softening point 132° C. glass transition point 60° C.) | 100 |
| Carbon black, MA#8 (Mitsubishi Chemical Industries, Ltd.) | 5 |
| Nigrosine dye, Bondoron N-01 (Oriental Chemical Industries, Ltd.) | 3 |

After the aforesaid materials were adequately mixed by a ball mill, and kneaded onto three rolls heated to 140° C. After leaving the mixture to stand to cool, it was coarsely pulverized with a feather mill, then finely powdered in a jet mill. The powder was then classified by a blow method into fine particles having a mean diameter of 8 μm.

PRODUCTION EXAMPLE 4

Negative Charge Toner

Toner was prepared using the following composition in the same manner as described in Example 1.

| Composition | Parts By Weight |
|---|---|
| Polyester resin (softening point 130° C., acid value 25 hydration value 38, glass transition point 60° C.) | 100 |
| Carbon black, MA#8 | 5 |

-continued

| Composition | Parts By Weight |
|---|---|
| (Mitsubishi Chemical Industries, Ltd.) | |

PRODUCTION EXAMPLE 5

| Composition | Parts By Weight |
|---|---|
| Polyester resin (softening point 123° C., acid value 23 hydration value 40, glass transition point 65° C.) | 100 |
| Inorganic magnetic powder (EPT-1000, Toda Kogyo, K.K.) | 500 |
| Carbon black, MA#8 (Mitsubishi Chemical Industries, Ltd.) | 2 |

The aforesaid materials were adequately mixed and pulverized in a Henschel mixer, then fused and kneaded in an extrusion kneading machine set at 180° C. at the cylinder portion and 170° C. at the cylinder head portion. After the mixture was cooled and finely powder in a jet mill, it was classified using a classifying device to obtain magnetic carrier having a mean particle diameter of 55 μm.

PRODUCTION EXAMPLE 6

A toluene solution (2%) of bis-phenol polyester resin (softening point123° C., glass transition point 65° C., acid value 21) was prepared. A core material of ferrite F-250HR (mean particle diameter 50 μm; electrical resistance $3.50\times10^8$ Ωcm; Nippon Teppun K. K.) was spray processed for 120 min at a rate of 300 parts by weight using a spira cota SP-40 under the following conditions: spray pressure 3.5 kg/cm, spray volume: 40 g/min, temperature: 50° C. The obtained particles screened (mesh size 105 μm) to eliminate agglomerates, thereby obtaining the coated carrier "a."

The aforesaid coated carr+="a" and fine particles of Fe-Zn ferrite MFP-2 (electrical resistance: $5.21\times10^8$ Ωcm, TDK K. K.) were mixed at a rate of 400 to 4 parts by weight using an angmill AM-20F ( Osokawa Micron K. K. ) for 40 min at 1,000 rpm. The obtained carrier powder was screened (mesh size 105 μm) to remove agglomerates, thereby obtaining the resultant carrier.

EXAMPLE 1

A developing device was filled with a developer having a toner mixing ration of 8 wt% using the spherical toner (positive charge) obtained in Example 1 and the carrier obtained in Example 5. On the other hand, the aforesaid carrier and irregularly shaped toner (positive charge) obtained in Irregularly Shaped Toner Example 3 were introduced to a supply device and copies were made using the electrophotographic copy machine shown in FIG. 1. The processing conditions were as follows:

| | |
|---|---|
| System speed | 28 cm/s |
| Photosensitive member surface potential | −700 V |
| Developing bias | −150 V |
| Adhesion bias (bias voltage of the sleeve in the supply device) | +400 V |
| Erase exposure | 1,000 lux |

Excellent copy images were obtained, and no cleaning problems arose.

EXAMPLE 2

In Example 2, copies were made in an identical manner to that described in Example 1, with the exception that spherical toner (positive charge) was used. High quality images were obtained, and no cleaning problems were observed.

EXAMPLE 3

Using the spherical toner (positive charge) obtained in Production Example 2 and carrier obtained in Production Example 6 , a developer having a toner mixing ratio of 8 wt % was obtained and introduced into a main developing device. On the other hand, the aforesaid carrier and irregularly shaped toner (positive charge) obtained in Irregularly Shaped Toner Production Example 3 were introduced into a supply device used to deposit said irregularly shaped toner onto the surface of the photosensitive member and copies were thereafter made. The processing conditions were as follows:

| | |
|---|---|
| System speed | 20 cm/s |
| Photosensitive member surface potential | −550 V |
| Developing bias | −100 V |
| Adhesion bias | +300 V |
| Erase exposure | 1,000 lux |

Excellent copy images were obtained, and no cleaning problems arose.

EXAMPLE 4

The copy process was identical to that described in Example 1 with the exception that the system speed was 35 cm/s Excellent images were obtained, and no cleaning problems were observed. That is, excellent cleaning characteristics can be obtained according to the process of the present invention regardless of the system speed employed, and no cleaning problems arise even when spherical toner is used. Consistently high quality images can therefore be obtained.

EXAMPLES 5 to 8

In Example 5 to 8, irregularly shaped toner (negative charge) obtained in Irregularly Shaped Toner Example 4 was used instead of the irregularly shaped toner (positive charge) used in Examples 1 through 4. Processing conditions were identical to those described in Examples 1 through 4 with the exception that the adhesion bias (bias voltage of the sleeve in the supply device) polarity was reversed. Copies were made as described in Examples 1 through 4 and invariably excellent images were obtained with no cleaning problems.

EXAMPLE 9

The materials were prepared in an identical manner to that described in Example 1 with the exception that styrene n-butylmethacrylate resin (softening point: 132° C., glass transition point: 60° C.) was pulverized in a jet pulverizer so as to obtain particles having a mean particle diameter of 8 um for use as the irregularly shaped particles introduced to a supply device. Copies were then made as described in Example 1, and excellent images were obtained with no cleaning problems.

COMPARATIVE EXAMPLES 1 to 4

Image formation was accomplished in the same manner as described in Examples 1 through 4 with the exception that the supply device 17 in FIG. 1 was removed. In all cases the first copy image was excellent, but image quality showed progressive deterioration from the second copy due to cleaning problems.

When spherical toner is used without installing a supply device which employs irregularly shaped toner, cleaning characteristics progressively deteriorate and excellent images cannot be obtained.

The process of the present invention, as clearly described heretofore by way of examples, provides sharp, accurate images with superior cleaning characteristics relative to the photosensitive member.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a rotatably disposed photosensitive member;

an image forming means for forming an electrostatic latent image on a surface of said photosensitive member;

developing means accommodating a spherical toner for developing the electrostatic latent image formed on the surface of the photosensitive member by said spherical toner;

transfer means for transferring the developed image onto a transfer material;

toner supplying means accommodating an irregularly shaped toner for supplying said irregularly shaped toner onto the surface of the photosensitive member, said irregularly shaped toner having a polarity opposite to that of the photosensitive member, wherein said toner supplying means is located downstream of the transfer means and upstream of the cleaning means with respect to a direction of rotation of the photosensitive member; and cleaning means for cleaning the residue of the spherical toner and the irregularly shaped toner from the surface of the photosensitive member simultaneously.

2. An image forming apparatus as claimed in claim 1 wherein said cleaning means includes a blade member for removing the spherical toner and the irregularly shaped toner from the surface of the photosensitive member.

3. An image forming apparatus as claimed in claim 1, wherein a size of the spherical toner particles is 3–20 μm and a size of the irregularly shaped toner particles is 5–20 μm.

4. An image forming apparatus as claimed in claim 3, wherein an average size of the irregularly shaped toner particles is smaller than an average size of the spherical shaped toner particles.

5. An image forming apparatus comprising:

a rotatably disposed photosensitive member;

an image forming means for forming an electrostatic latent image on a surface of said photosensitive member;

developing means accommodating a spherical toner for developing the electrostatic latent image formed on the surface of the photosensitive member by said spherical toner;

transfer means for transferring the developed image onto a transfer material;

toner supplying means accommodating an irregularly shaped toner for supplying said irregularly shaped toner to the spherical shaped toner, said irregularly shaped toner having a polarity opposite to that of the spherical shaped toner, wherein said toner supplying means is located downstream of the transfer means and upstream of the cleaning means with respect to a direction of rotation of the photosensitive member, and cleaning means for cleaning the residue of the spherical toner and the irregularly shaped toner from the surface of the photosensitive member simultaneously.

6. An image forming apparatus as claimed in claim 5 wherein said cleaning means includes a blade member for removing the spherical toner and the irregularly shaped toner from the surface of the photosensitive member.

7. An image forming apparatus as claimed in claim 14, wherein a size of the spherical toner particles is 3–20 μm and a size of the irregularly shaped toner particles is 5–20 μm.

8. An image forming apparatus as claimed in claim 5, wherein an average size of the irregularly shaped toner particles is smaller than an average size of the spherical shaped toner particles.

9. An image forming apparatus comprising:

a rotatably disposed photosensitive member;

an image forming means for forming an electrostatic latent image on a surface of said photosensitive member;

developing means accommodating a spherical toner for developing the electrostatic latent image formed on the surface of the photosensitive member by said spherical toner;

transfer means for transferring the developed image onto a transfer material;

toner supplying means accommodating an irregularly shaped toner for supplying said irregularly shaped toner onto the surface of the photosensitive member, wherein said toner supplying means is located downstream of the transfer means and upstream of the cleaning means with respect to a direction of rotation of the photosensitive member; and cleaning means for cleaning the residue of the spherical toner and the irregularly shaped toner from the surface of the photosensitive member simultaneously.

10. An image forming apparatus comprising:

a rotatably disposed photosensitive member;

an image forming means for forming an electrostatic latent image on a surface of said photosensitive member;

developing means accommodating a spherical toner for developing the electrostatic latent image formed on the surface of the photosensitive member by said spherical toner;

transfer means for transferring the developed image onto a transfer material;

toner supplying means accommodating an irregularly shaped toner for supplying said irregularly shaped toner to the spherical shaped toner, wherein said toner supplying means is located downstream of the transfer means and upstream of the cleaning means with respect to a direction of rotation of the photosensitive member, and cleaning means for cleaning the residue of the spherical toner and the irregularly shaped toner from the surface of the photosensitive member simultaneously.

* * * * *